US006840180B2

(12) United States Patent
Ulmer

(10) Patent No.: US 6,840,180 B2
(45) Date of Patent: Jan. 11, 2005

(54) PORTABLE ADJUSTABLE TABLE

(76) Inventor: Matthew J. Ulmer, 3510 Louise Ave., Indianapolis, IN (US) 46234

( * ) Notice: Subject to any disclaimer, the term of this patent is extended or adjusted under 35 U.S.C. 154(b) by 0 days.

(21) Appl. No.: 09/989,592

(22) Filed: Nov. 20, 2001

(65) Prior Publication Data

US 2003/0094123 A1 May 22, 2003

(51) Int. Cl.[7] ..... A47B 85/00

(52) U.S. Cl. ..... 108/13; 108/38; 108/150; 108/26

(58) Field of Search ..... 108/150, 38, 13, 108/34, 11, 14, 19, 12, 90, 26

(56) References Cited

U.S. PATENT DOCUMENTS

| | | | | |
|---|---|---|---|---|
| 69,148 | A | * | 9/1867 | Wood |
| 383,333 | A | | 5/1888 | Wolz |
| 466,303 | A | | 12/1891 | Hetterschied |
| 1,325,164 | A | * | 12/1919 | Mowrey |
| 1,349,710 | A | | 8/1920 | Beeson |
| 1,850,420 | A | * | 3/1932 | Schuldt |
| 1,929,551 | A | * | 10/1933 | Hamilton |
| 2,568,534 | A | * | 9/1951 | Baker |
| 2,664,147 | A | | 12/1953 | O'Keefe et al. |
| 3,176,676 | A | * | 4/1965 | Caldwell |
| 3,368,858 | A | * | 2/1968 | Motter et al. |
| 3,583,090 | A | * | 6/1971 | Fogarty |
| 3,936,109 | A | * | 2/1976 | Richardson |
| 4,365,561 | A | | 12/1982 | Tellier et al. |
| 4,833,999 | A | * | 5/1989 | Rhoades |
| 5,174,223 | A | | 12/1992 | Nagy et al. |
| 5,208,084 | A | | 5/1993 | Rutz |
| 5,803,416 | A | | 9/1998 | Hanson et al. |
| 5,806,943 | A | * | 9/1998 | Dell et al. |
| 5,915,659 | A | | 6/1999 | Scannell, Jr. |
| 5,941,352 | A | | 8/1999 | Lee |
| 6,092,474 | A | | 7/2000 | Chen |
| 6,182,583 | B1 | * | 2/2001 | Larson |
| 6,397,761 | B1 | * | 6/2002 | Moore |

FOREIGN PATENT DOCUMENTS

EP 0051952 A1 * 5/1982

OTHER PUBLICATIONS

Ryobi Technologies, Inc.; 18.0V Cordless "Six Pack"; www.ryobitools.com; 2002.

Lizell; SkyMall Magazine; "Redefining Your Workspace"; Portable Office, www.lizell.com; at least as early as 2000.

Web Page, <http://www.flightable.com/Model-ToOrder.htm>; AZPAC International, LLC; Flightable Models to order; Travel Pac Model V–2500E and Model V–1600E.

* cited by examiner

*Primary Examiner*—Jose V. Chen
(74) *Attorney, Agent, or Firm*—Woodard, Emhardt, Moriarty, McNett & Henry LLP

(57) ABSTRACT

A lightweight, portable table that is easily transportable. The inventive table includes two interchangeable table tops, one of which includes a compartment that can hold and transport the remainder of the table when disassembled. The top which houses the remainder of the table's components can be fitted with handles and removable wheels to facilitate transportation of the table. The table tops are pivotable about an upstanding support to allow an infinite variety of positions for the user.

11 Claims, 8 Drawing Sheets

PORTABLE ADJUSTABLE TABLE

FIELD OF THE INVENTION

The present invention relates generally to tables and more particularly to portable multipurpose tables.

BACKGROUND

Many computer simulation games are best appreciated in a comfortable and flexible environment. However, many commercially available work stations that are adaptable for computers or video games are large, confining and time-consuming to assemble. Furthermore, the available work stations or tables known to applicant do not adequately provide for accessories such as joysticks, flight yokes and rudder or auto pedals that are included in many computer simulation games; nor are the available tables adequately flexible such that the user of the computer simulation can become comfortable. Finally, most commercially available work stations suitable for use with computer simulations are not portable, such that the traveling "simmer" or "gamemer" often cannot comfortably enjoy his or her computer simulation while traveling.

Many ergonomic features for tables and work stations have been developed and are disclosed in the prior art. For example, U.S. Pat. Nos. 2,664,147; 1,349,710 and 6,092,474 disclose tables whose tops have an indented portion that accommodates the user. The '147 patent discloses a friction lock mechanism for telescopic height adjustment of the table top, which mechanism also allows the table top to pivot. U.S. Pat. Nos. 466,303; 5,915,659 and 383,333 disclose vertically adjustable tables that also tilt. U.S. Pat. No. 4,365,561 discloses a computer table that tilts and pivots.

However, none of the prior art just noted adequately addresses the need for a flexible, easily portable table or work station that provides an ergonomic environment for computer simulations.

SUMMARY OF THE INVENTION

The present invention provides a lightweight, portable table that is easily transportable. The inventive table includes two interchangeable table tops, one of which includes a compartment that can hold and transport the remainder of the table when disassembled. The table tops are pivotable about an upstanding support to allow an infinite variety of positions for the user.

In one form thereof, the present invention provides a portable table, comprising a base and a support member extending upwardly from the base. First and second table tops are provided that are removably and interchangeably attachable to the support member. The first table top is conveniently storable within a compartment of the second table top, and in preferred embodiments, the base and said support fit within the compartment as well. Preferably, the second table top includes a handle and wheels for transport thereof.

In another form thereof, the present invention provides a portable table, comprising a base, a support member extending upwardly from the base, and first and second table tops removably and interchangeably attachable to the support. The first table top is removably and hingedly attachable to said second table top.

One advantage of the present invention is that it provides freedom from a traditional computer work station. The present invention provides a more comfortable, relaxed and flexible environment especially suitable to enjoy the intensity of modem computer simulations.

Another advantage of the present invention is its portability. The components for the entire table can be conveniently stored in the "tub top" provided with the table. More conveniently, the tub top includes wheels and a handle for easy transportation.

Yet another advantage of the present invention is that the base provides two rectangular shaped open sections that accommodate pedals or other accessories for a computer simulation.

Still another advantage of the present invention is its light weight. The disclosed embodiment weighs only 12 to 15 pounds, making the unit easy to lift and transport.

Still another advantage of the present invention is the ease with which it can be assembled and disassembled for storage and transportation. The table includes only four major parts and can be assembled or disassembled by hand, without any tools.

BRIEF DESCRIPTION OF DRAWINGS

The above-mentioned and other advantages of the present invention, and the manner of obtaining them, will become more apparent and the invention itself will be better understood by reference to the following description of the embodiments of the invention taken in conjunction with the accompanying drawings, wherein.

Corresponding reference characters indicate corresponding parts throughout the several views.

DETAILED DESCRIPTION

The embodiments of the present invention described below are not intended to be exhaustive or to limit the invention to the precise forms disclosed in the following detailed description. Rather, the embodiments are chosen and described so that others skilled in the art may appreciate and understand the principles and practices of the present invention.

Figure 1:
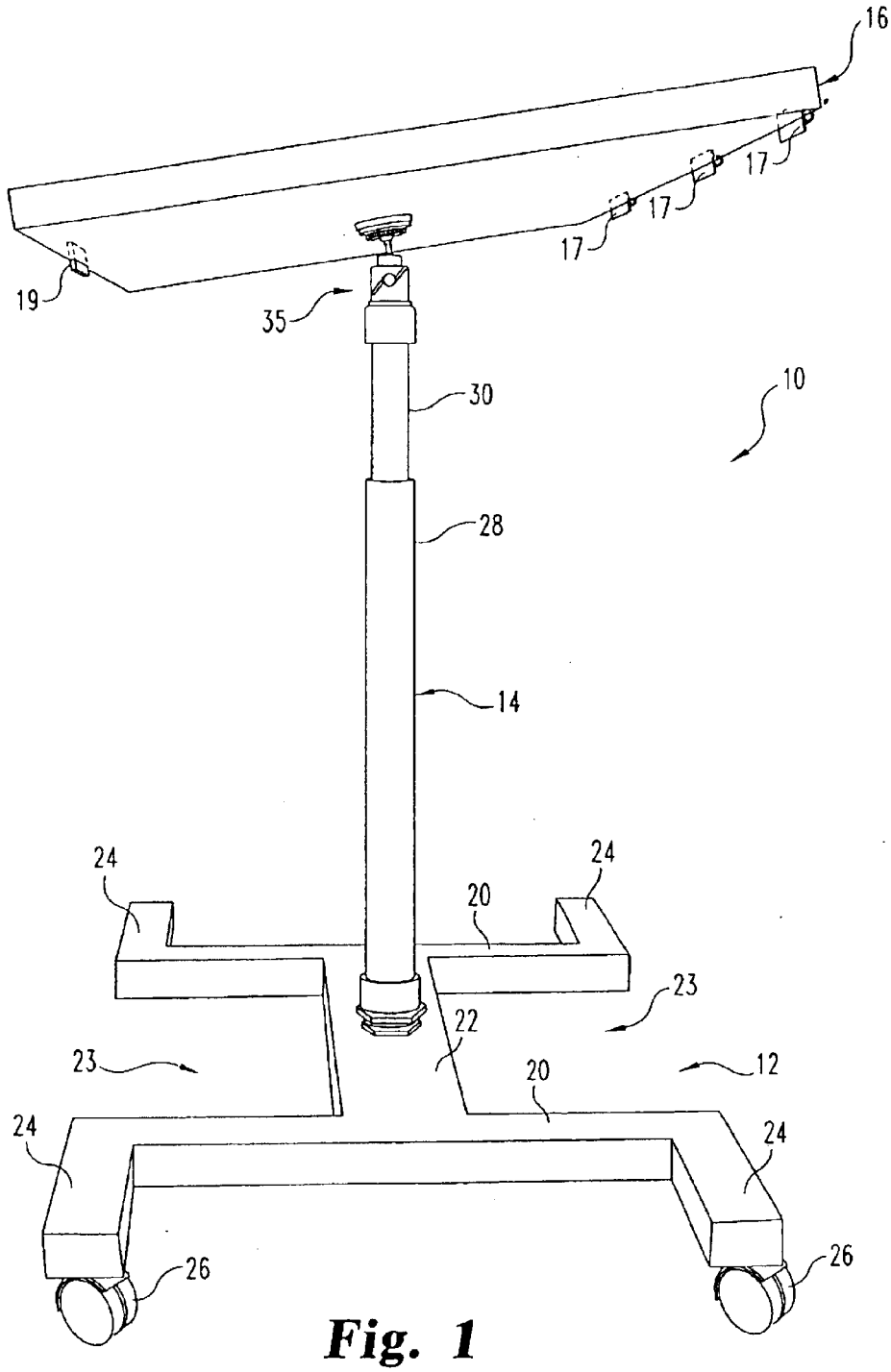
FIG. 1 is a perspective view illustrating a table in accordance with the present invention.
Figure 1A:
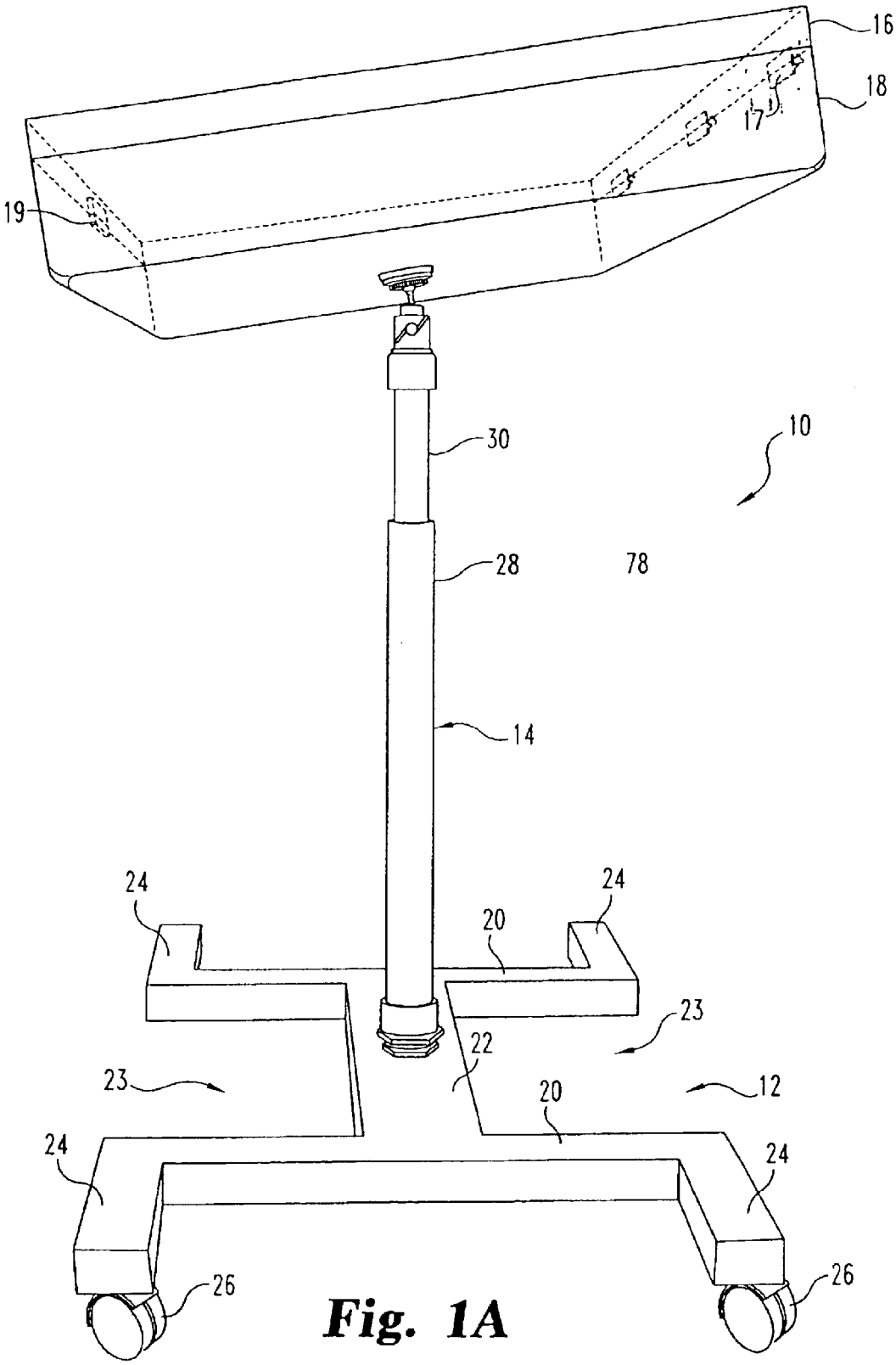
FIG. 1A is a perspective view illustrating the table of FIG. 1 with a different top.

Referring now to FIG. 1, portable table 10 includes H-shaped base 12 and support member 14 extending upwardly therefrom. A table top 16 is removably attached to support member 14 and is interchangeable with or, optionally, attaches to a second (tub) table top 18 (FIG. 1A) by means of detachable hinges 17 and latch mechanism 19, as described in more detail below.

Figure 2:
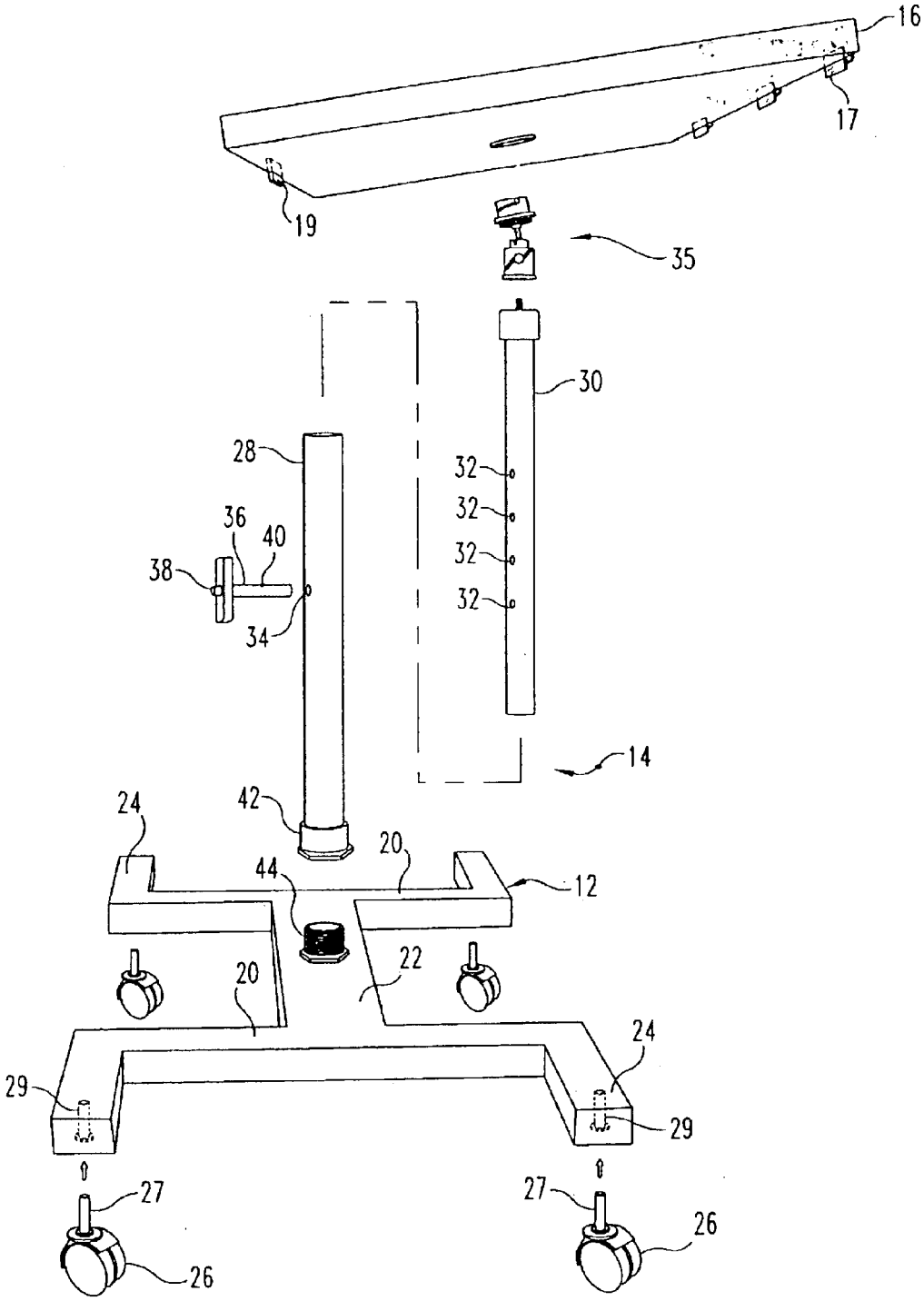
FIG. 2 is an exploded perspective view of the table 1.

H-shaped base 12 includes two elongate beam members 20 disposed substantially parallel to one another and connected by a cross member 22 disposed substantially orthogonally to beam members 20. Support member 14 extends upwardly from cross member 22. Cross member 22 and beam members 20 form two substantially rectangular open sections 23 which are adapted for the placement of an accessory, as explained in more detail below. Each beam member 20 includes bent sections 24 at both ends thereof. Caster wheels 26 are removably attached to distal portions of bent sections 24, such that wheels 26 are spaced away from open sections 23, which reduces interference to the "foot space" created by open sections 23. With reference to FIG. 2, stem 27 of wheel 26 is received into receptacle 29. H-shaped base 12 can be formed of any of a variety of materials, but it is preferred that the material chosen be sufficiently strong yet lightweight. Suitable materials include injection-molded, reinforced polymer, lightweight metals such as aluminum, steel and titanium, and the like. One of ordinary skill in the art would readily recognize many suitable materials for base 12.

Turning now to FIG. 2, support member 14 includes two telescopic segments 28 and 30 as shown. A series of spaced holes 32 is disposed on segment 30. When segment 30 is inserted and telescopes within segment 28, one of holes 32 can be selected (depending upon desired height of table top 16) and aligned with hole 34 disposed on segment 28. T-Pin 36 is then inserted through aligned holes 34 and 32 to hold table top 16 at a desired height. T-pin 36 includes a button 38, depression of which contracts a bearing 40 to allow T-Pin 36 to be inserted or removed from support member 14. The bottom end of support member 14 includes a female threaded end 42 which threadingly engages male threaded end 44 of base 12. Support member 14 and segments 28 and 30 thereof can be formed of any of a variety of materials, but it is preferred that the material chosen be sufficiently strong yet lightweight. Suitable materials include poly vinyl chloride (PVC) pipe, injection-molded, reinforced polymer, lightweight metals such as aluminum, steel and titanium, and the like, and combinations thereof. One of ordinary skill in the art would readily recognize many suitable materials for support 14.

Figure 1B:
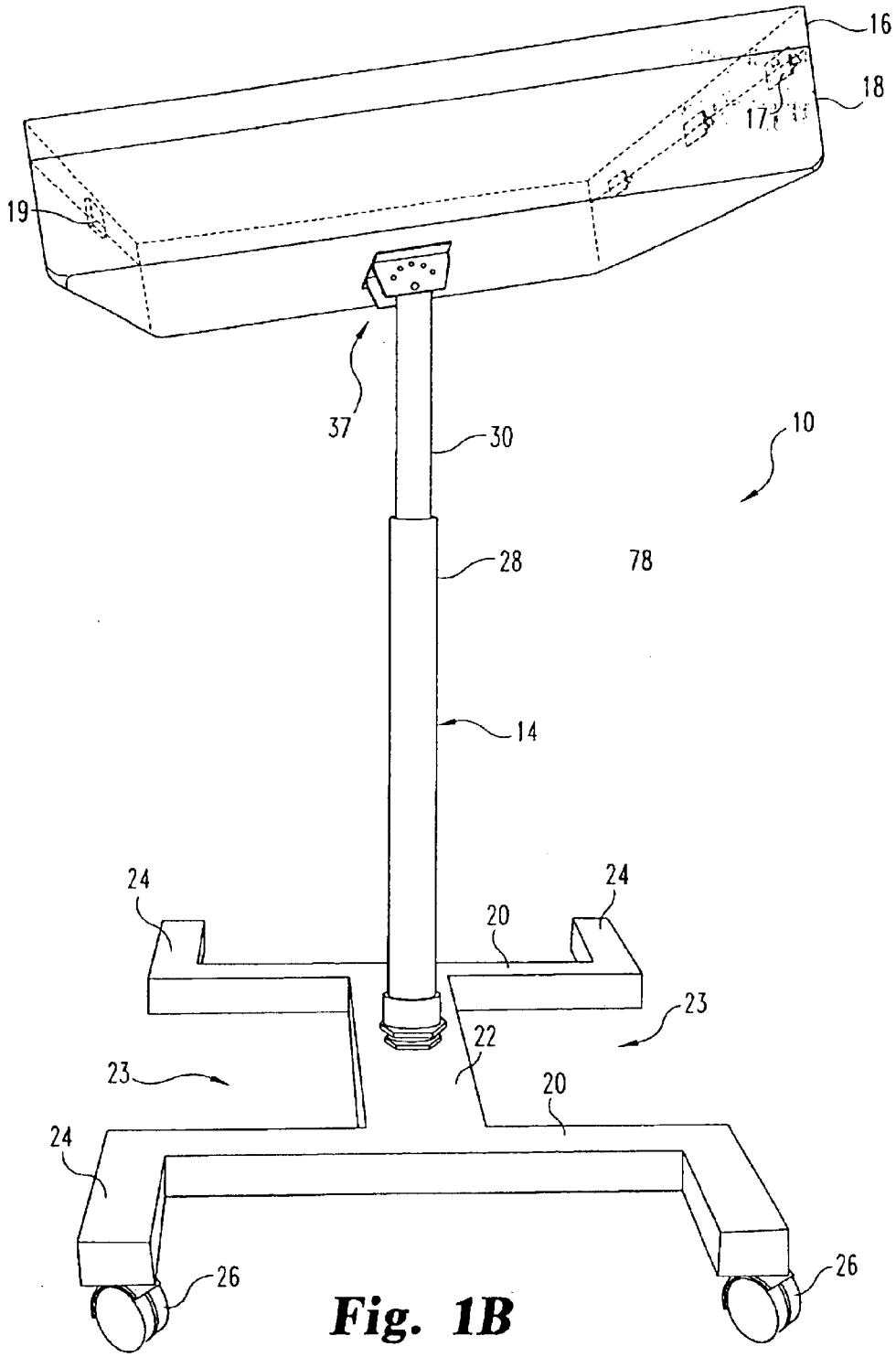
FIG. 1B is a perspective view of the table in FIG. 1 with a different connection between the table top and the support post.
Figure 3:
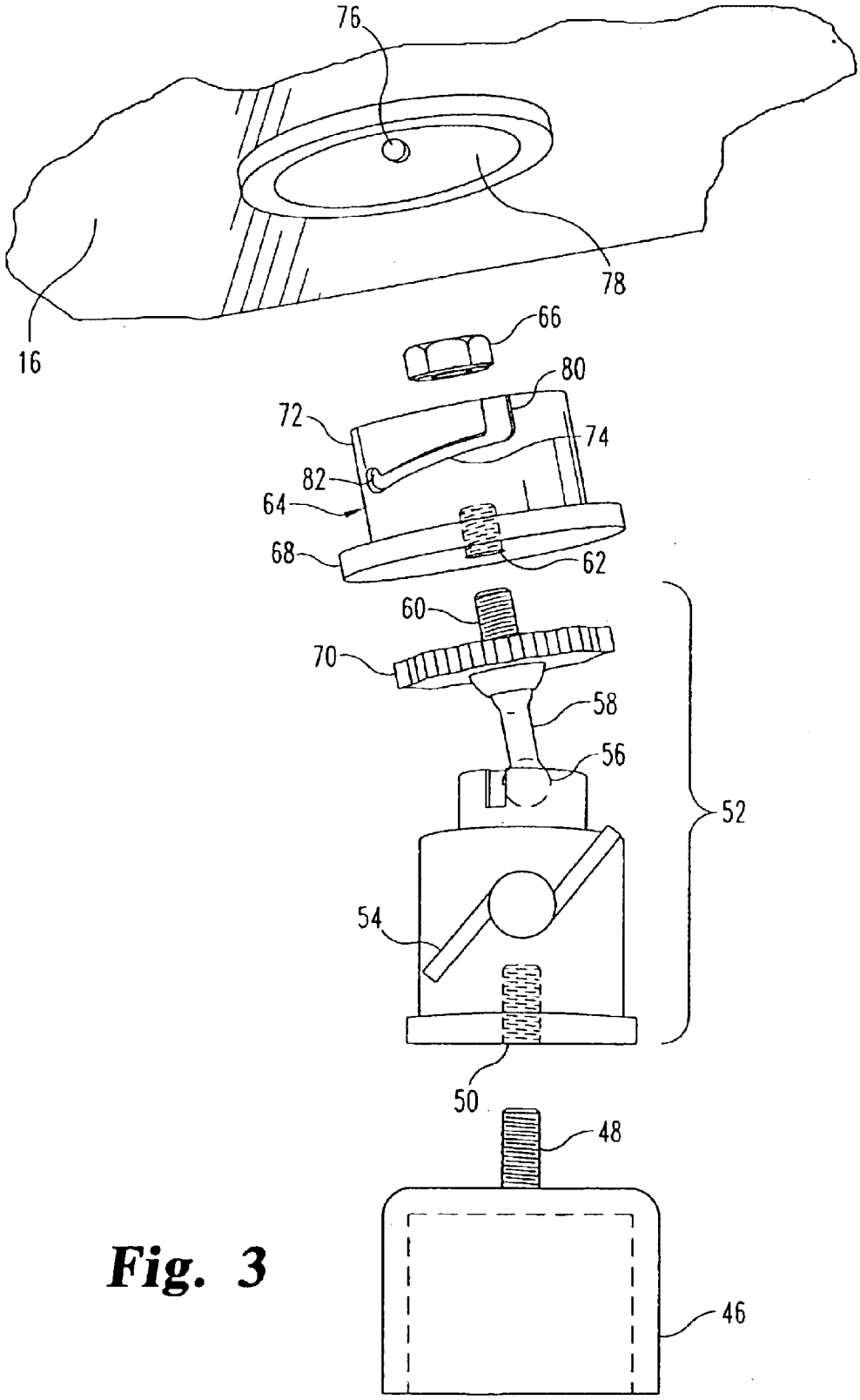
FIG. 3 is an enlarged perspective view of the ball and socket mechanism which connects the table top to the support.

By comparing FIGS. 1 and 1B, it can be appreciated that two different connection mechanisms 35 and 37 can be used to connect the table top 16 or 18 to support 14. Turning now to FIG. 3, the connection mechanism 35 between support member 14 and table top 16 or 18 can be appreciated. Cap 46 of support 14 includes an extending male threaded member 48 that threadingly engages female threaded bore 50 (shown in phantom) so that connector 52 is removably connected to support member 14. Ball and socket connector 52 includes wingnut 54, which when tightened holds ball 56 at the end of stem 58 in place. A ball and socket connector 52 suitable for the embodiments incorporating the present invention is a Manfrotto 3009, made in Italy, distributed by Bogen, and available from Roberts' Distributors, Indianapolis, Ind. It will be readily recognized by one of ordinary skill in the art that many commercially available ball joints could be substituted for the part just mentioned. Ball and socket connector 52 allows stem 58 and thus table top 16 or 18 to pivot freely about support member 14 when wingnut 54 is loosened, thereby allowing table top 16 to be tilted to the preference of the user, whereupon wingnut 54 is tightened to secure the table top in place.

As further shown in FIG. 3, stem 58 includes a threaded male connector 6 that is received through annular bore 62 of quick disconnect 64. Nut 66 is threadingly received over threaded connector 60, thereby securing quick disconnect fitting 64 to ball and socket connector 52. Flange 68 mates with washer 70 to form a secure fit. Sleeve 72 of quick disconnect 64 defines a bent groove 74 that receives a nub 76 protruding from the surface of annular recess 78 disposed in the bottom of table top 16 (or table top 18, whichever the case may be). A second nub (not shown) and mating groove (not shown) positioned opposite the illustrated nub 76 and groove 74 may be provided. To secure the table top 16 to the support, sleeve 72 is inserted into recess 78 such that nub 76 slides into the vertical portion 80 of groove 74, and sleeve 72 is then twisted until nub 76 is positioned within the upward end 82 of groove 74 and thereby releasably locked in place. The table top 16 can pivot about the ball and socket mechanism 52.

Figure 3A:
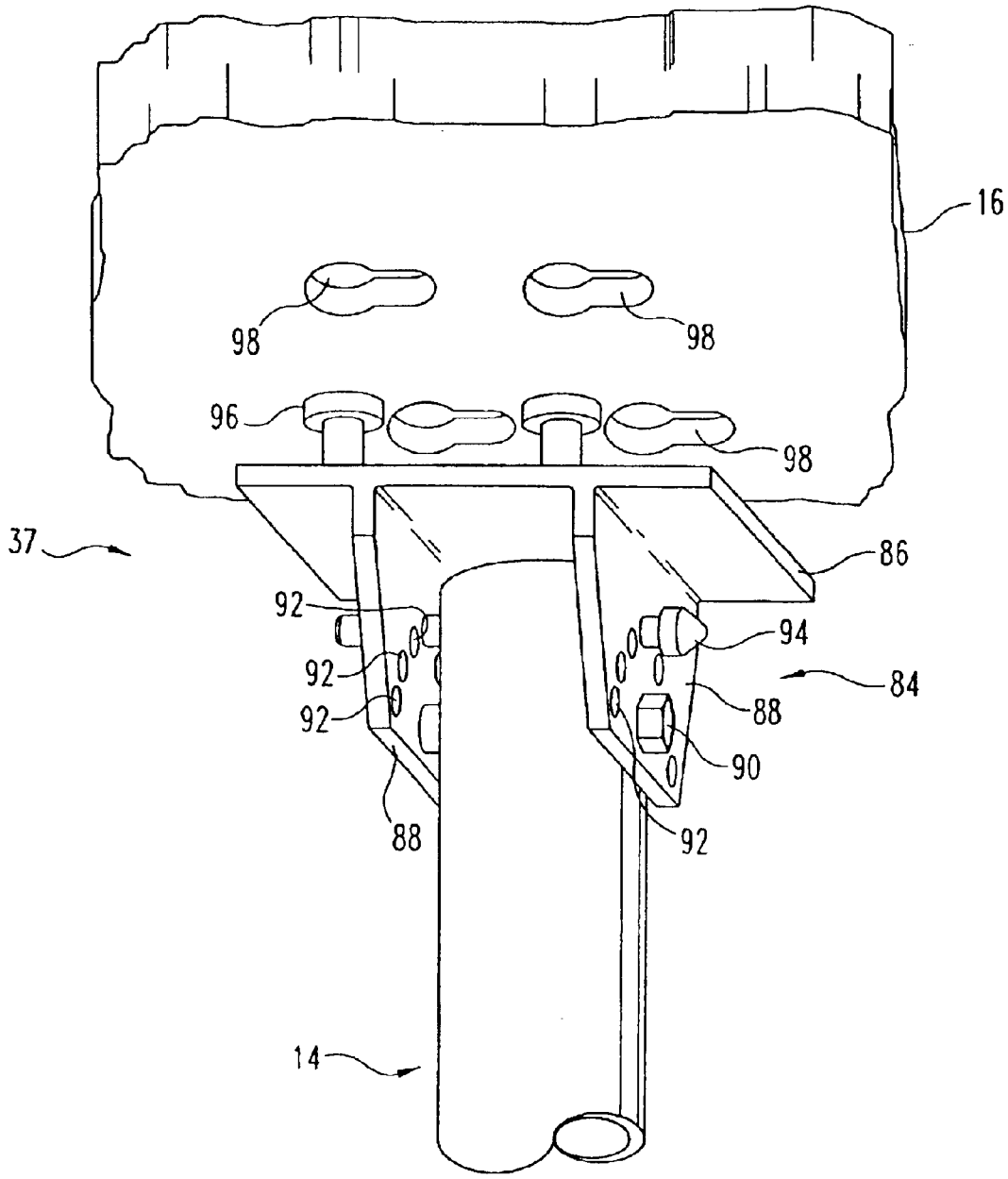
FIG. 3A is an enlarged perspective view of an alternate mechanism which connects the table top to the support and which is also illustrated in FIG. 1B.

An alternate connection mechanism 37 is shown in FIG. 3A. Bracket 84 is comprised of a top plate 86 having two parallel, spaced plates 88 depending downwardly therefrom. Plates 88 include mating holes that receive bolt 90 therethrough which pivotably attaches bracket 84 to support 14. Plates 88 each also include a set of holes 92 arranged in an arc, corresponding ones of which receive removable pin 94. Corresponding holes (not shown) are also formed in support 14 to receive pin 94. Depending upon the particular holes 92 selected to receive pin 94 therethrough, bracket 84 will tilt to varying degrees, up to about 45 degrees in either direction, and table top 16 will tilt accordingly therewith. Table top 16 is secured to bracket 84 and thus support 14 by means of upstanding stool-shaped pegs 96 which are inserted into corresponding ones of keyhole recesses 98. Table top 16 is then shifted relative to pegs 96 such that the smaller ends of keyhole recesses 98 hold the pegs and thus table top 16 in place.

It should be understood that table tops 16 and 18 are interchangeable with respect to connection mechanism 35 or 37. For example, if connection mechanism 35 is employed, both table top 16 and 18 will include an annular recess 78 shown and described with reference to FIG. 3, above. Likewise, if connection mechanism 37 is chosen, table tops 16 and 18 will both be configured with keyhole recesses as shown and described with reference to FIG. 3A. Table top 16 may be used with (FIGS. 1A and 1B) or without (FIG. 1) table top 18. As alluded to above, hinges 17 removably engage table top 18 and latch 19 secures table top 16 to table top 18.

Figure 5:
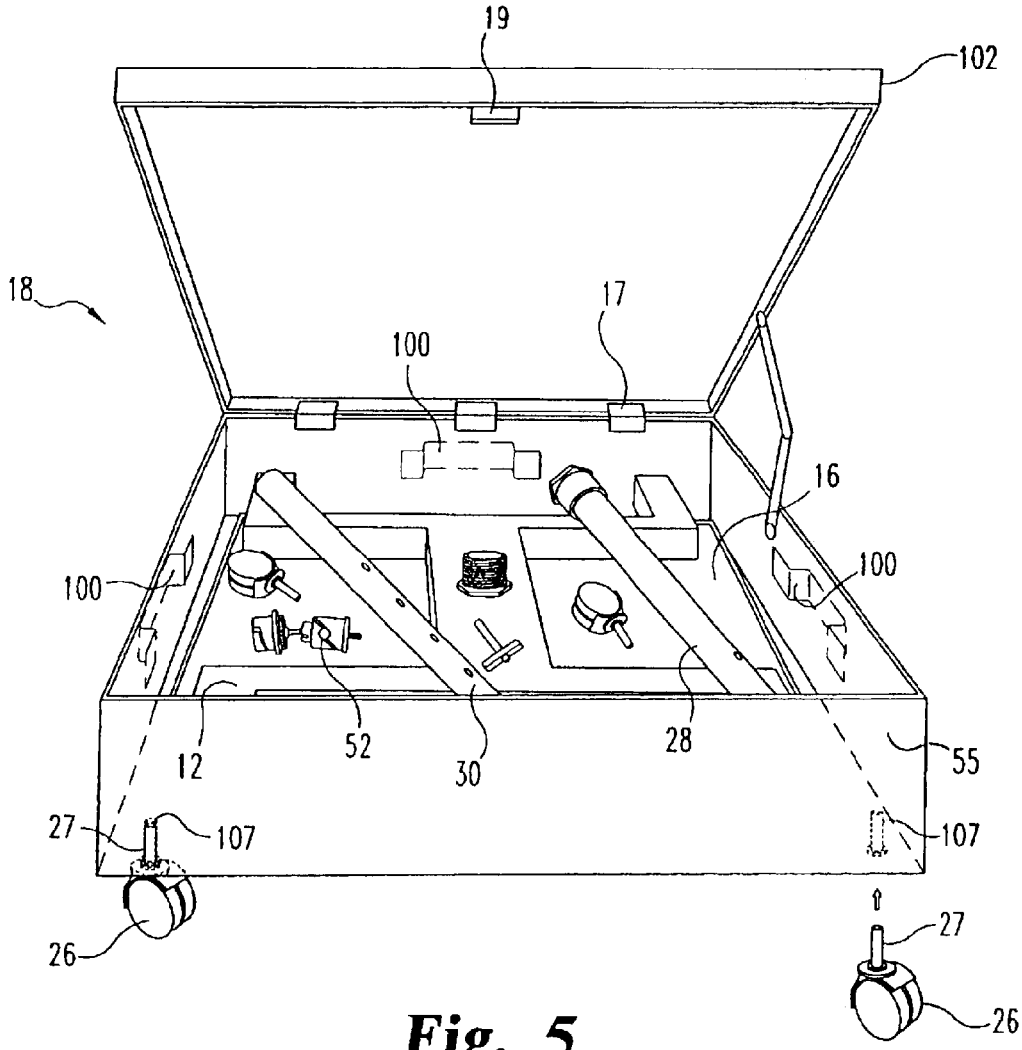
FIG. 5 is a perspective view of the table top depicted in FIG. 1A, illustrating the capacity of the table top to house the components of the table when disassembled.

In the alternate embodiment shown in FIG. 5, top 18 is configured slightly larger than top 16, such that top 16 can be stored within top 18 as shown. Table top 18 includes a cover 102 hingedly attached thereto. This type of arrangement is desirable to avoid damage to top 16 during transportation and storage of table 10. As shown in FIG. 5, the contents of the entire table can be taken apart and stored within table top 18. Means (not shown) to fix the components within top 18, such as spaced arms, Velcro, separate compartments, etc. can be provided so that the components do not shift when table 10 is transported. Further, removable casters 26 can be taken from base 12 and stems 27 thereof inserted into receptacles 107 in table top 18 such that the entire unit may be easily wheeled from one place to the next. Although not shown in FIG. 5, the receptacles for the wheels can be mounted to wall 55 of top 18 instead of as shown. Optional handles 100 can be configured in one or more places on table top 18 to facilitate transport of same.

Figure 4:
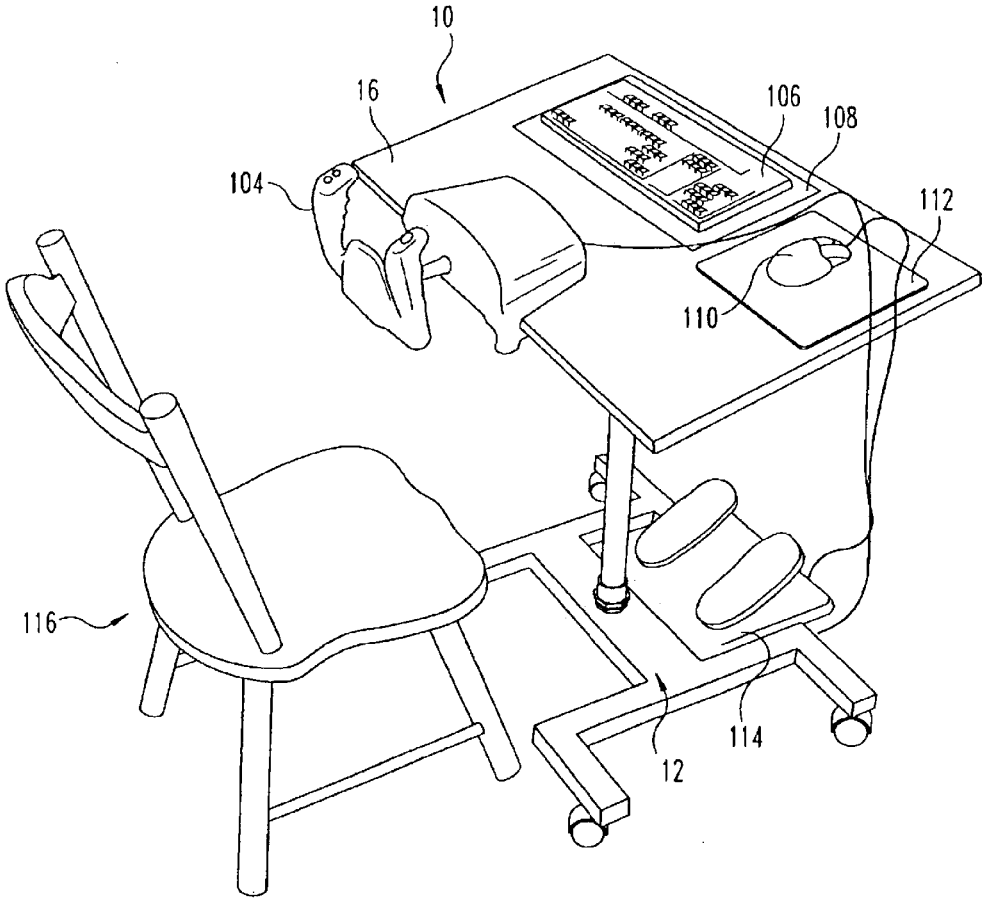
FIG. 4 is a perspective view of a table in accordance with the present invention which illustrates accessories that may be used with the table.

Turning now to FIG. 4, some of the common uses of table 10 are illustrated. Table 10 is shown with game steering assembly 104 attached to table top 16 and computer keyboard 106 placed on top of top 16. Keyboard 106 is placed on a pad 108 which is made of a tacky nonadhesive material to prevent the keyboard from slipping. A mouse 110 and mouse pad 112 are also placed on top 16. Pedal assembly 114 is placed in space 23 and provides easy access for the feet of the user (not shown) who would be seated in chair 116.

While a preferred embodiment incorporating the principles of the present invention has been disclosed hereinabove, the present invention is not limited to the disclosed embodiments. Instead, this application is intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A portable table, comprising:

a base;

first and second table tops;

a support member extending upwardly from said base and including a connection mechanism which removably and interchangeably attaches said first and second table tops to said support member; and said first table top sized to fit within a compartment of said second table top.

2. The portable table of claim 1, wherein said second table top includes a handle and wheels for transport thereof.

3. The portable table of claim 1, wherein said second table top includes a lid pivotally attached thereto, whereby said lid provides a work surface.

4. The portable table of claim 1, wherein said base and said support fit within said compartment.

5. The portable table of claim 1, wherein said base includes a detachable wheel, said wheel also attachable to said second table top.

6. The portable table of claim 1, wherein said second table top comprises a lid, four walls and a bottom forming said compartment therewithin, said lid being pivotably attached to one of said walls and forming a work surface.

7. A portable table, comprising:

a base;

first and second table tops;

a support member extending upwardly from said base and including a connection mechanism which removably and interchangeably attaches said first and second table tops to said support member; and wherein said first table top removably and hingedly attaches to said second table top.

8. The portable table of claim 7, wherein said second table top includes a handle and wheels for transport thereof.

9. The portable table of claim 7, wherein said base and said support fit within said second table top.

10. The portable table of claim 7, wherein said base includes a detachable wheel, said wheel also attachable to said second table top.

11. The portable table of claim 7, wherein said second table top comprises a lid, four walls and a bottom forming a compartment therewithin, and first table top being pivotably attached to one of said walls and forming a work surface.

* * * * *